United States Patent [19]

Horan

[11] Patent Number: 4,567,731

[45] Date of Patent: Feb. 4, 1986

[54] ARTIFICIAL ICEBERG

[76] Inventor: Robert J. Horan, 14 Mechanic Ave., Endicott, N.Y. 13760

[21] Appl. No.: 669,076

[22] Filed: Nov. 7, 1984

[51] Int. Cl.[4] ..... F25D 3/00

[52] U.S. Cl. ..... 62/59; 62/74; 62/347; 405/61; 405/217

[58] Field of Search ..... 62/1, 74, 347, 59; 405/52, 61, 217

[56] References Cited

U.S. PATENT DOCUMENTS

| | | | |
|---|---|---|---|
| 3,244,870 | 4/1966 | Gallant et al. | 62/74 |
| 3,750,412 | 8/1973 | Fitch et al. | 62/1 |
| 3,849,993 | 11/1974 | Robinson et al. | 62/1 |
| 4,048,808 | 9/1977 | Duthweiler | 62/260 |
| 4,055,052 | 10/1977 | Metge | 62/260 |
| 4,431,339 | 2/1984 | Bickham | 405/61 |
| 4,432,669 | 2/1984 | Cox et al. | 405/61 |

*Primary Examiner*—Ronald C. Capossela

[57] ABSTRACT

An artificial iceberg is constructed in an area near the ocean, which has a plentiful supply of fresh water and a climate in which the temperature remains below freezing for extended periods of time. An air pocket is created by fixing a sheet of plastic to a suitable base. Fresh water is then sprayed in layers atop the air pocket until the desired thickness is obtained. Said artificial iceberg will also have tow ropes and Horizontal Drift Eliminators (H.D.E.) implanted during manufacture to facilitate transportation on large bodies of water.

8 Claims, 11 Drawing Figures

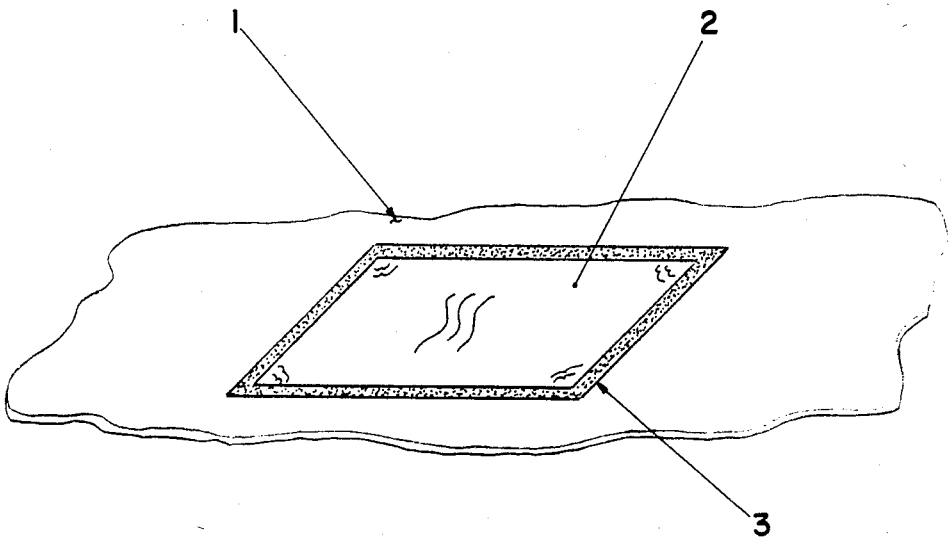
FIG. # 1

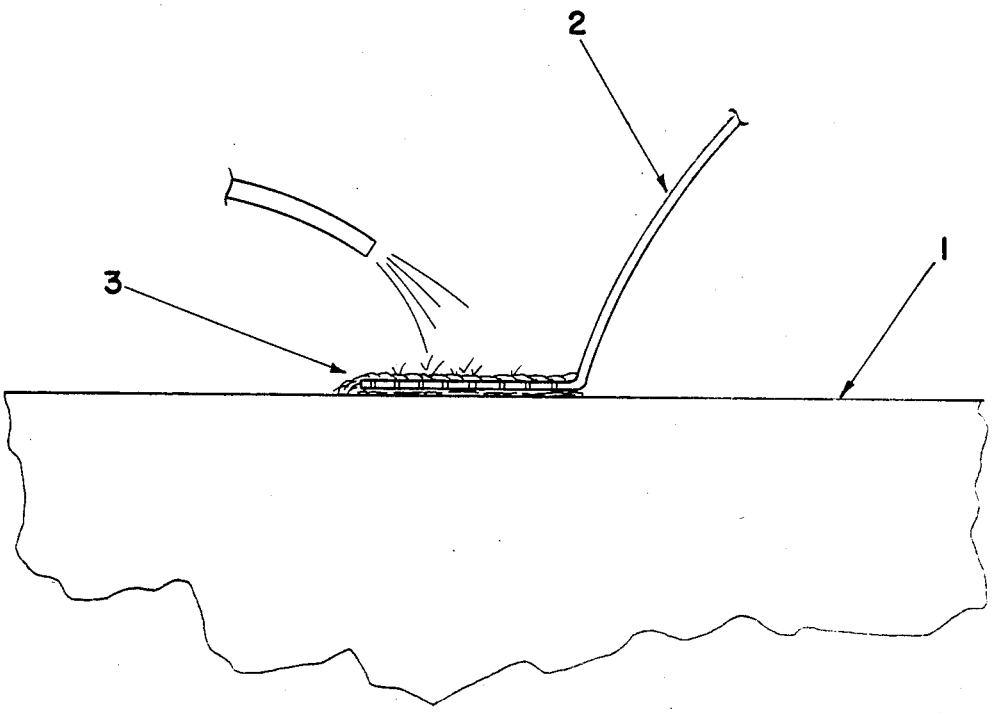
FIG. # 1A

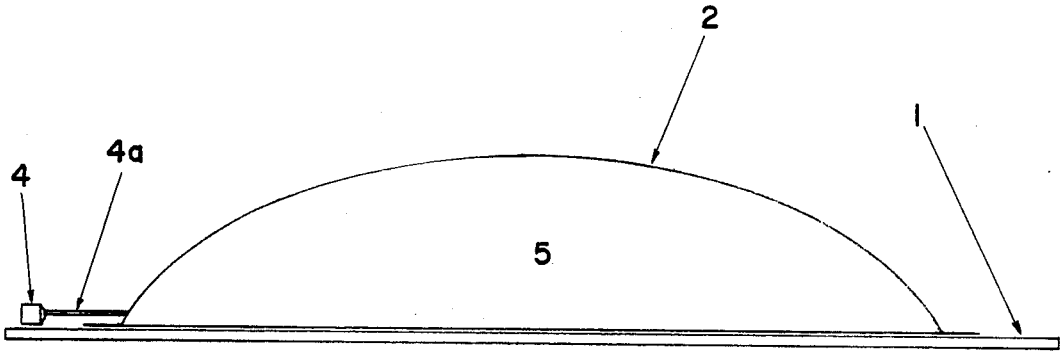
FIG. # 2

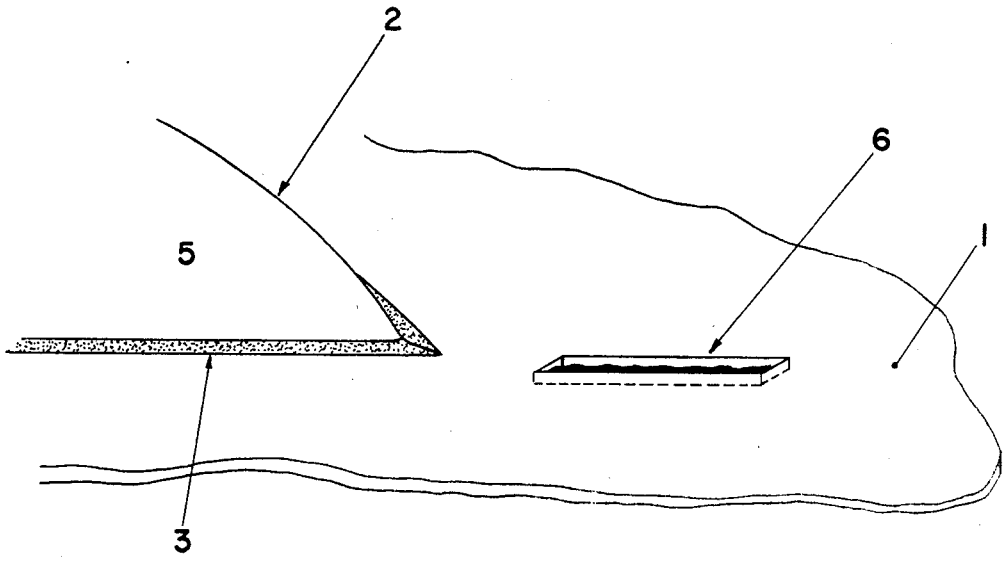
FIG. # 3

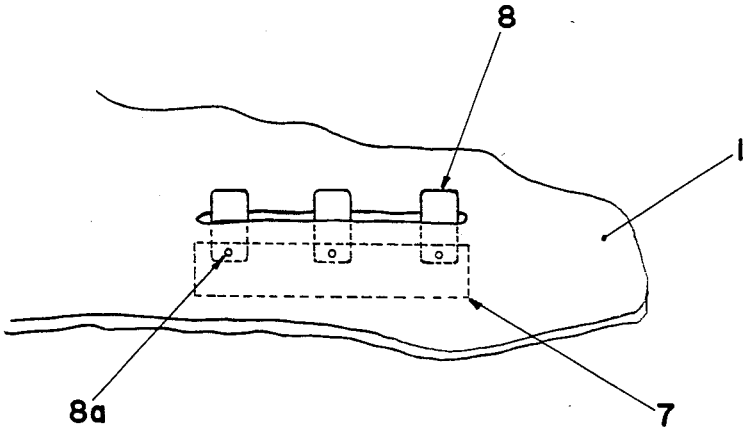
FIG. # 4

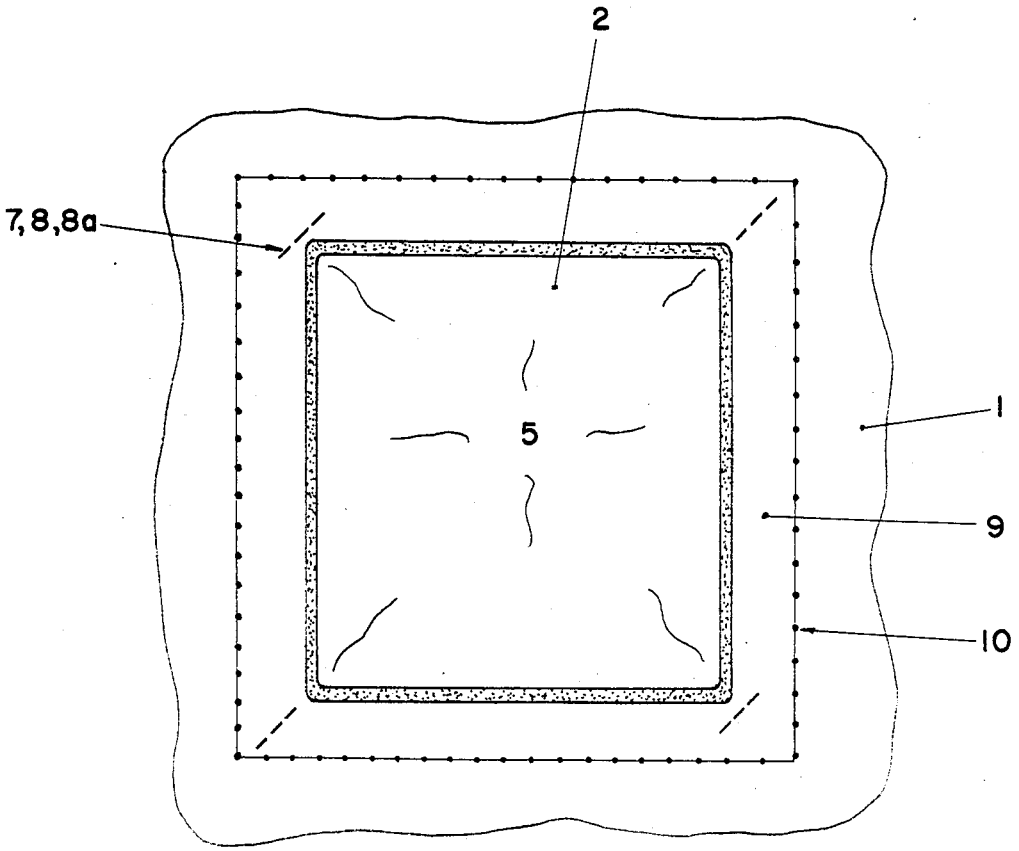
FIG.#5

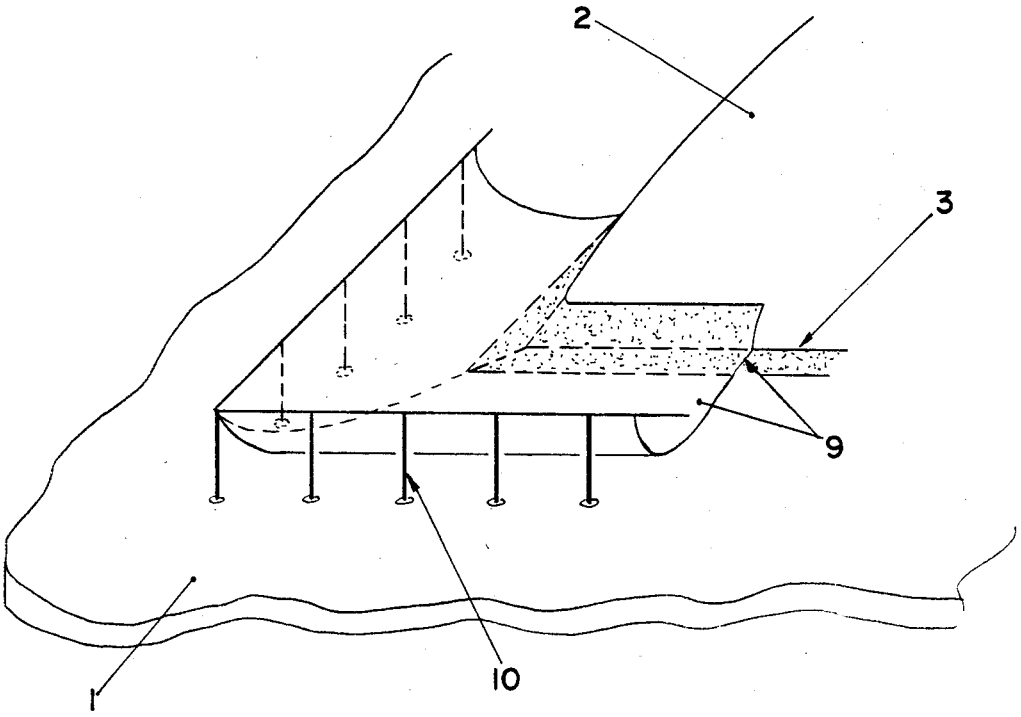
FIG. # 5A

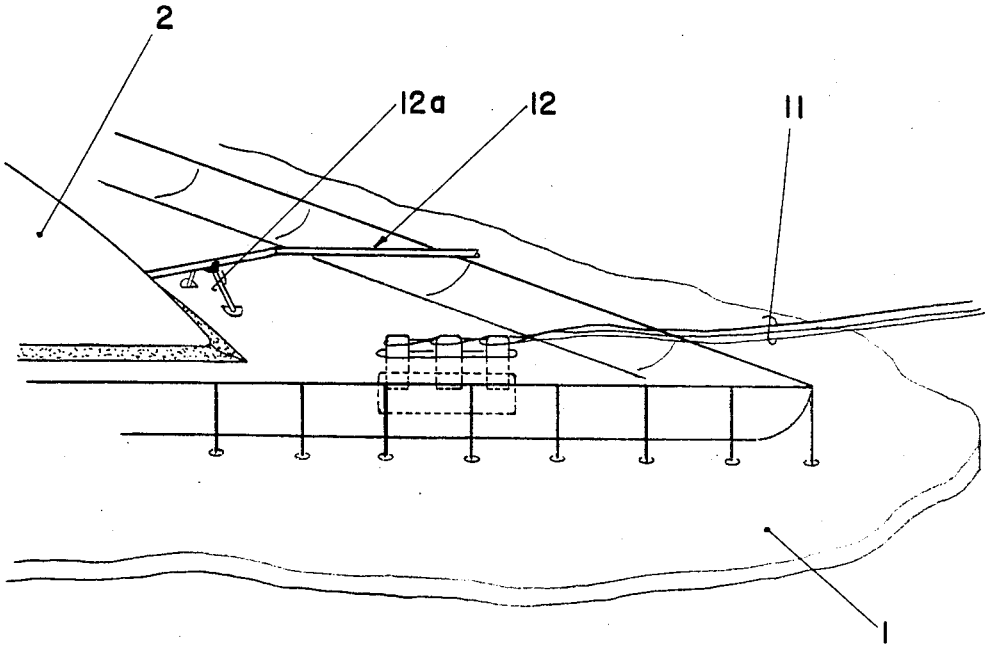
FIG. # 6

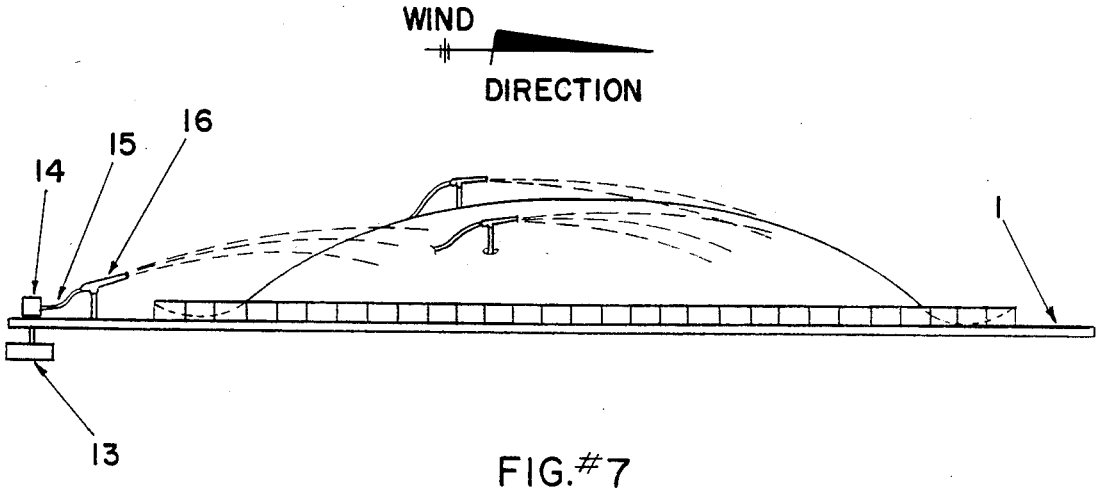
FIG.#7

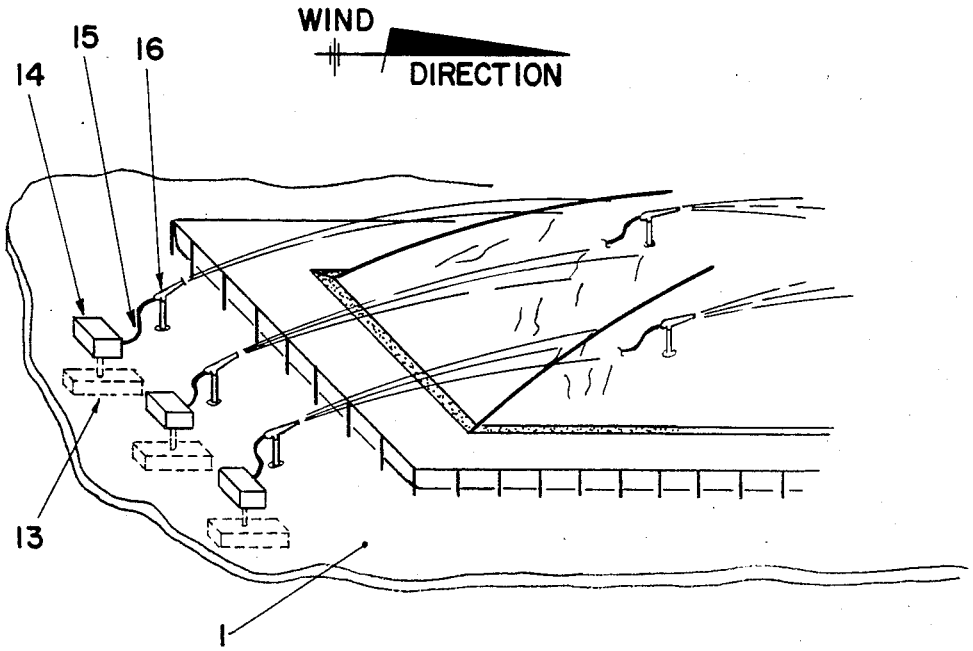
FIG. # 8

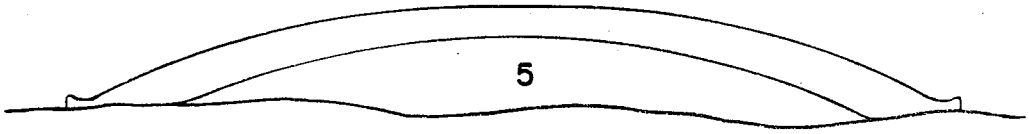
FIG. # 9
SECTIONAL VIEW
OF ICEBERG

ARTIFICIAL ICEBERG

BACKGROUND AND PRIOR ATTEMPTS

Engineers have tried to move large pieces of ice in the past, however, several major problems have prevented their success. The first problem is that such a large percentage of a piece of ice is below the surface of the water that it creates a very high drag coefficient.

The second obstacle to overcome is the phenomenon of "rolling". This occurs when the center of gravity of a large piece of ice shifts due to melting and/or breakage and makes the whole piece unstable.

The third problem is the fact that water erodes ice very quickly when the ice is being pulled through the water.

The final problem which must be dealt with is the occurrence of "calving" in which large pieces of ice break away from the main block.

All four of these problems will be controlled or eliminated by this invention.

SUMMARY OF THE INVENTION

This invention provides a method for the manufacture of a large piece of ice in a sub zero climate. The process will facilitate the transportation of large amounts of fresh water ice to various regions which are in need of fresh water.

The method of creating said "artificial iceberg" involves attaching a large sheet of plastic to a suitable base. Air will be pumped under the edges of the plastic to form an air pocket. When the air pocket is complete, fresh water is sprayed on the surface of the plastic and allowed to freeze in layers. Tow ropes and Horizontal Drift Eliminators (H.D.E.) are installed in the iceberg during the manufacturing process and the layered ice holds them in place. When the artificial iceberg has reached the desired thickness, it can be towed to whatever destination is desired where it can be used for irrigation, recreation, or personal consumption.

BRIEF DESCRIPTION OF THE DRAWINGS

FIG. 1 and FIG. 1A are views of the starting procedure for an artificial iceberg.

FIG. 2 shows the set up for inflating the plastic sheet.

FIG. 3 shows the preperation for installation of the horizontal drift eliminators.

FIG. 4 and FIG. 4A show the H.D.E. installation.

FIG. 5 and FIG. 5A show the outside lower layer of plastic which is used to protect the ice from erosion by the water during transportation.

FIG. 6 shows the installation of the tow ropes.

FIG. 7 is a side view of the artificial iceberg at the start of the manufacturing process.

FIG. 8 shows top view of FIG. 7.

FIG. 9 shows the artificial iceberg. (section view) finished.

DETAILED DESCRIPTION OF THE INVENTION

Preferred Procedure

The description of the preferred procedure begins with the selection of a suitable location. This location will most likely be an estuary formed by a river flowing into the ocean. With a fresh water supply and a sub-zero environment, a natural ice sheet (FIG. 1, Item 1) will form. When a thickness of approximately 4 to 6 inches is reached in the natural ice sheet, construction can begin. A sheet of plastic (FIG. 1, Item 2) is spread out on the natural ice sheet. The edges of the plastic sheet, which contain holes (FIG. 1, Item 3), are moved toward the center of the natural ice sheet. Water is then sprayed on the edges of the plastic (See inset FIG. 1) and allowed to freeze forming ice "rivets" through the holes which will hold the edges down and form an airtight seal around the circumference of the plastic sheet. Next, an air pump (FIG. 2 Item 4) and an air line (FIG. 2, Item 4*a*) are used to force compressed air under the plastic sheet to form an air pocket (FIG. 2, Item 5). (The air line will be installed under the edge of the plastic sheet during the initial preparation.)

After the air pocket has been formed, slits (FIG. 3, Item 6) are cut into the natural ice sheet which will be used to install the horizontal drift eliminators (H.D.E.) (FIG. 4, Item 7). Each H.D.E. will have two or more studs (FIG. 4, Item 8) which will be anchored in the iceberg as the thickness of the ice layers covers them.

Each horizontal drift eliminator stud will be equipped with a locking pin (FIG. 4, Item 8*a*) which will enable the H.D.E. to be detached from the iceberg once the desired destination has been reached. Once the natural ice sheet has been prepared, an outside lower layer of plastic (FIG. 5, Item 9) will be installed to keep water from touching the bottom of the artificial iceberg during transportation. Poles (FIG. 5, Item 10) will also be erected to hold the plastic sides up and to contain the fresh water. The installation of tow ropes (FIG. 6, Item 11) to be used in the moving process and the installation of an air duct (FIG. 6, Item 12) which will be used to supply air to the air pocket will take place next.

A filter (FIG. 7, Item 13) and pump (FIG. 7, Item 14) will pump fresh water through the water line (FIG. 7, Item 15) and nozzle (FIG. 7, Item 16) to spray fresh water over the entire surface of the air pocket. When a thickness of approximately one foot of ice has been achieved, and the pressure has reached approximately 1 psi, an automatic system (FIG. 8, Item 17) for spraying fresh water will be installed. The automatic system will continue to spray in a 360 degree sweep (FIG. 9) until the desired thickness of ice is achieved. The air pressure will continue to rise as the thickness and weight of ice on the air pocket increases.

Finally, pegs, will be installed in the surface of the iceberg, below the level of the bottom plastic sheet (FIG. 5, Item 9). These pegs will be used to secure an additional sheet of plastic which will cover the entire iceberg when it is finished. After the iceberg is completed, it can be cut from the natural ice sheet and towed to the desired destination.

Alternative Procedures

The first alternative to the preferred procedure would be to lay a large sheet of plastic flat on top of the natural ice sheet. This sheet of plastic would also have holes in the edges placed to align with the holes in a second sheet (FIG. 1, Item 2) which is used, as in the preferred procedure, to form the air pocket. In this way, the air pocket would be formed entirely of plastic.

The second alternative would be to apply the sheet of plastic (FIG. 1, Item 2) directly to the earth. The plastic is attached to the earth in the same manner as in the preferred procedure and the construction proceeds in the same way from there.

A third alternative would be to install hollow tubes with the horizontal drift eliminators (FIG. 4, Item 7).

Instead of studs (FIG. 4, Item 8) embedded in the ice, there would be a single stud which would pass through the pipe to the surface of the iceberg. This would make the horizontal drift eliminators moveable.

The fourth alternative would be to have long poles embedded in the ice to be used as masts so that sails could be used to help in transporting the artificial iceberg.

The fifth alternative would be to freeze two or more artificial icebergs together creating one large iceberg which could easily be cut apart at a later date.

I claim:

1. A process of creating an artifical iceberg comprising:

providing an ice base floating on the surface of the ocean, fastening a layer of plastic sheet material having a first and second surface to the ice base, conveying compressed air into the space between the ice base the first surface of the plastic sheet material thereby creating an air pocket, spraying fresh water on the second surface of the sheet material to form a layer of ice, continuing the spraying of the fresh water to build the iceberg to the desired thickness.

2. The process of creating an artificial iceberg according to claim 1 further including the step of:

cutting holes in the periphery of the plastic sheet material and spraying fresh water thereon wherein the water freezes the sheet material to the ice base.

3. An artificial iceberg formed in an environment wherein the temperature is below 0° C. comprising:

a base, a layer of sheet material fastened to said base, said layer having a first surface facing said base and a second surface opposite said first surface, a source of compressed air and means for conveying compressed air to the area between the first surface and said base wherein an air pocket is formed, means for spraying fresh water on the second surface wherein the water freezes and forms a layer of ice.

4. The iceberg of claim 3 further comprising vertical stabilizing members fastened to said base at their proximate end with horizontal drift eliminators positioned at their distal ends.

5. The vertical stabilizing members as set forth in claim 4 comprising an outer sleeve member fixidly positioned on said base and an inner tubular member movably positioned on said base with the inner tubular member movably positioned therein.

6. The vertical stabilizing member of claim 5 further comprising a pivot bar and locking ribs connected to the proximate end of the inner tubular member and the hoizontal drift eliminator positioned at its distal end wherein the inner tubular member can be raised, rotated and lowered in order to change the position of the horizontal drift eliminators.

7. The iceberg of claim 3 further including means for altering the shape of the layer of sheet material.

8. The iceberg of claim 3 further including tow roper fastened to said base.

* * * * *